US006497204B1

(12) United States Patent
Miyazaki et al.

(10) Patent No.: US 6,497,204 B1
(45) Date of Patent: Dec. 24, 2002

(54) STRATIFIED SCAVENGING TWO-STROKE CYCLE ENGINE

(75) Inventors: Hiroshi Miyazaki, Musashimurayama (JP); Takamasa Otsuji, Tachikawa (JP)

(73) Assignee: Komatsu Zenoah, Co., Kawagoe (JP)

( * ) Notice: Subject to any disclaimer, the term of this patent is extended or adjusted under 35 U.S.C. 154(b) by 0 days.

(21) Appl. No.: 09/959,047

(22) PCT Filed: Mar. 29, 2000

(86) PCT No.: PCT/JP00/01943

§ 371 (c)(1),
(2), (4) Date: Oct. 15, 2001

(87) PCT Pub. No.: WO00/65209

PCT Pub. Date: Nov. 2, 2000

(30) Foreign Application Priority Data

Apr. 23, 1999 (JP) ..... 11/117118

(51) Int. Cl.[7] ..... F02B 33/04

(52) U.S. Cl. ..... 123/73 PP; 123/73 A; 123/65 A

(58) Field of Search ..... 123/73 A, 73 PP, 123/65 A

(56) References Cited

U.S. PATENT DOCUMENTS 4,191,141 A 3/1980 Franke ..... 123/65 A
4,876,999 A 10/1989 Schierling et al. ..... 123/252
5,379,732 A 1/1995 Mavinahally et al. ... 123/73 AA

FOREIGN PATENT DOCUMENTS

JP 51-19208 A 2/1976
JP 55-4518 Y2 2/1980
JP 7-269356 A 10/1995
JP 10-252565 A 9/1998
WO WO98-57053 A1 12/1988

*Primary Examiner*—Noah P. Kamen
(74) *Attorney, Agent, or Firm*—Sidley Austin Brown & Wood LLP

(57) ABSTRACT

The engine can improve a leading air suction efficiency, has a simple structure and a low cost. Accordingly, in a stratified scavenging two-stroke cycle engine provided with an exhaust port (22) and a scavenging port (21) which are connected to a cylinder chamber (10), a leading air suction port (24) not connected to the cylinder chamber and a crank chamber (11), an air-fuel mixture suction port (23) connected to the crank chamber, a scavenging flow passage (20) connecting between the scavenging port and the crank chamber, and a piston groove (25) connecting between the leading air suction port and the scavenging port and not connecting between the air-fuel mixture suction port and the scavenging port at a time of a suction stroke, and disposed in an outer peripheral portion of the piston (4), the leading air suction port is positioned at an opposite side to the air-fuel mixture suction port with respect to an axis of the cylinder (3).

3 Claims, 16 Drawing Sheets

STRATIFIED SCAVENGING TWO-STROKE CYCLE ENGINE

The present invention relates to a stratified scavenging two-stroke cycle engine, and more particularly to a piston valve type stratified scavenging two-stroke cycle engine which separately sucks an air-fuel mixture and leading air for scavenging.

BACKGROUND ART

Conventionally, as an example of a piston valve type stratified scavenging two-stroke cycle engine having a piston groove for connecting a leading air sucking port and a scavenging port in an outer peripheral portion of a piston, there has been known a structure which is disclosed in International Laid-Open WO 98/57053.

FIGS. 12 and 13 show one structural embodiment of the stratified scavenging two-stroke cycle engine described in WO 98/57053. A piston 4 is provided so as to be slidably and in a sealing manner inserted within a cylinder 3. The piston 4 is connected to a crank 5 within a crank chamber 11 via a connecting, rod 6. A space portion, in which a capacity above the piston 4 within the cylinder 3 changes, forms a cylinder chamber 10. Two scavenging flow passages 20 and 20, communicating the cylinder chamber 10 with the crank chamber 11, are provided on opposite side surfaces of the cylinder 3. The respective scavenging flow passages 20 and 20 are open as scavenging ports 21 and 21 to the cylinder chamber 10. An exhaust port is provided in a side of the cylinder 3 adjacent a top dead center side of the piston 4 at a position above the scavenging ports 21 and 21 in an axial direction of the cylinder 3. Further, an air-fuel mixture suction port 23 and leading air suction ports 24 and 24, disposed adjacent opposite sides of the air-fuel mixture port 23, are provided on an inner peripheral surface of the cylinder 3. A through hole 31 is provided in a lower portion of the piston 4. Piston grooves 25 and 25, respectively communicating the leading air suction ports 24 and 24 with the scavenging ports 21 and 21 in correspondence to a vertical motion of the piston 4, are provided in right and left outer peripheral surfaces with respect to the through hole 31.

As shown in FIG. 14, in order to prevent the leading air suction ports 24 and 24 and the air-fuel mixture suction port 23 from communicating with each other throughout all of the strokes of the piston 4, the interval between the two leading air suction ports 24 and 24, that is, the interval K between the piston grooves 25 and 25, is set to be larger than the width M of the air-fuel mixture suction port 23.

In the stratified scavenging two-stroke cycle engine having the structure mentioned above, when the piston 4 moves upwardly from a bottom dead center, the pressure of the crank chamber 11 starts reducing and the pressure of the cylinder chamber 10 starts increasing, so that each scavenging port 21 and the exhaust port 22 are sequentially closed. Further, at this time, as shown in FIG. 14, the leading air suction ports 24 and 24 are in a state of being connected to the scavenging flow passages 20 and 20 via the piston grooves 25 and 25 and the scavenging ports 21 and 21 at a position close to and below the top dead center, and the air-fuel mixture suction port 23 is opened so as to become in a state of being connected to the crank chamber 11 via the through hole 31. Accordingly, the air is sucked within the crank chamber 11 from the leading air suction ports 24 and 24 via the scavenging flow passages 20 and 20. At this time, inner portions of the scavenging flow passages 20 and 20 become in a state of being full of the air.

When the piston further moves upwardly and the piston 4 reaches a point close to the top dead center, the air-fuel mixture within the cylinder chamber 10 is ignited and exploded, whereby the piston 4 starts moving downwardly. Accordingly, the pressure of the crank chamber 11 starts increasing, the piston grooves 25 and 25 become in a state of being shut off from the leading air suction ports 24 and 24 and the scavenging ports 21 and 21, and the air-fuel mixture suction port 23 becomes in a state of being closed by the piston 4, so that the pressure within the crank chamber 11 increases.

In the middle of the downward movement of the piston 4, the exhaust port 22 and the scavenging ports 21 and 21 become sequentially in a state of being opened to the cylinder chamber 10, and combustion gas is at first discharged from the exhaust port 22. Next, the air stored within the scavenging flow passages 20 and 20 is injected into the cylinder chamber 10 from the scavenging ports 21 and 21 due to the increased pressure within the crank chamber 11. Accordingly, the combustion gas left within the cylinder chamber 10 is expelled via the exhaust port 22 and a muffler (not shown) into atmospheric air. Next, the air-fuel mixture within the crank chamber 11 is charged into the cylinder chamber 10 via the scavenging flow passages 20 and 20 and the scavenging ports 21 and 21.

Further, the piston 4 starts moving upwardly from the bottom dead center, whereby the pressure within the crank chamber 11 starts reducing, and each scavenging port 21 and the exhaust port 22 are sequentially closed, so that the cycle mentioned above is again repeated.

Further, conventionally, an air control valve for adjusting an air supply amount is provided in an upstream side of the leading air suction port. As one embodiment thereof, there has been known Japanese Utility Model Publication No. 55-4518.

FIG. 15 shows one structural embodiment of a stratified scavenging two-stroke cycle engine described in Japanese Utility Model Publication No. 55-4518, and FIG. 16 is a cross sectional view along a line 16—16 in FIG. 15. The same reference numerals are attached to the same elements as those in FIG. 12, a description thereof will be omitted, and a description will be given only of different parts. A carburetor 50, having a suction air throttle valve 51, is provided in the air-fuel mixture suction port 23, which is open to the crank chamber 11. A two-forked branch pipe 61, attached to an air supply pipe 60 and branched into two air supply passages 62 and 62, is attached to the cylinder 3. The air supply passages 62 and 62 of the branch pipe 61 are communicated with the scavenging ports 21 and 21, which are open to the cylinder chamber 10. Check valves 65 and 65 are respectively provided in the air supply passages 62 and 62. An air control valve 63, having a butterfly type variable valve 64, is provided in the air supply pipe 60. The variable valve 64 is structured such as to be connected to the suction air throttle valve 51 of the carburetor 50 by a rod 52 so as to interlock therewith. An exhaust port 22 is provided on a surface of the cylinder 3 opposite from the air supply pipe 60.

In the structure mentioned above, when the piston 4 starts moving upwardly from the bottom dead center, the air is supplied to the scavenging ports 21 and 21 from the air supply pipe 60 via the air supply passages 62 and 62 of the branch pipe 61. Then, the amount of air is adjusted by the air control valve 63. The air control valve 63 is operated interlocking with the suction air throttle valve 51 in the carburetor 50 and is set so that 0 or a small amount of air is supplied at a time when the engine is under idling or under a low load operation, and an amount of air corresponding to an operation condition is supplied at the other operation times.

However, in the structure disclosed in WO 98/57053 mentioned above, the following problems are generated.

In order to increase a suction efficiency of the air-fuel mixture, it is necessary to form the air-fuel mixture suction port 23 to be equal to or more than a predetermined area. Further, in the same manner, in order to increase a suction efficiency and a scavenging efficiency of the leading air, it is necessary to form the scavenging ports 21 and 21 and the piston grooves 25 and 25 to be equal to or more than a predetermined area. Accordingly, although a detailed description is not given in WO 98/57053, the air-fuel mixture suction port 23, the scavenging ports 21 and 21, and the piston grooves 25 and 25 actually occupy a very large area, as shown in FIG. 17.

Further, in order to control so that the air supplied from the leading air suction ports 24 and 24 and the air-fuel mixture supplied from the air-fuel mixture suction port 23 do not mix, it is necessary to set the interval K between the two leading air suction ports 24 and 24 to be larger than the width M of the air-fuel mixture suction port 23. Accordingly, a width N of the leading air suction ports 24 and 24, positioned so as to be constrained between the air-fuel mixture suction port 23 and the scavenging ports 21 and 21, is reduced. Accordingly, the area of the leading air suction ports 24 and 24 is reduced, and there is generated a problem that a suction efficiency of the leading air is deteriorated.

Further, in the structure disclosed in Japanese Utility Model Publication No. 55-4518, the following problem is generated. Since the air supply pipe 60 having the air control valve 63 is attached to the cylinder 3 via the branch pipe 61, the number of the parts is increased, the structure is complex, and a placing space is large. Accordingly, in the case that a product is constituted by using the engine, it becomes hard to assemble the entire structure in a compact manner, so that there are problems that a general purpose property is deteriorated and the cost is increased.

SUMMARY OF THE INVENTION

As a means for solving the problems mentioned above which are generated by WO 98/57053, there can be considered a structure in which the air-fuel 1 mixture suction port 23 and the two leading air suction ports 24 and 24 are provided at positions shifted with respect to each other a predetermined distance in an axial direction of the cylinder 3, and the interval between the two leading air suction ports 24 and 24 is set to be smaller than the width of the air-fuel mixture suction port 23. FIG. 18 is a side elevational schematic view of the cylinder 3 which describes an embodiment structured in the manner mentioned above. In FIG. 18, the interval R between the two leading air suction ports 24 and 24 is set to be smaller than the width S of the air-fuel mixture suction port 23. Accordingly, it is possible to increase the width T of each of the leading air suction ports 24 and 24, and it is possible to set an area thereof to be sufficiently large.

However, in this structure, in all of the strokes of the piston 4, it is necessary to prevent a connection of the piston groove 25 to the air-fuel mixture suction port 23. Accordingly, it is necessary to increase a length L2 of the piston 4 at a degree of shifting the air-fuel mixture suction port 23 and the two leading air suction ports 24 and 24 with respect to each other in the axial direction of the cylinder 3. Accordingly, since the engine itself becomes large, there are problems that the weight is increased, an occupied space is increased and the cost is increased.

The present invention is made by paying attention to the problems mentioned above, and an object of the present invention is to provide a stratified scavenging two-stroke cycle engine which can improve a leading air suction efficiency, can make a piston compact, has a simple structure, has a reduced number of parts, has a small placing space, and has a low cost.

In accordance with the present invention, there is provided a stratified scavenging two-stroke cycle engine comprising an exhaust port and a scavenging port which are connected to a cylinder chamber of an engine, a leading air suction port which is not connected to the cylinder chamber and a crank chamber during all strokes of a piston, an air-fuel mixture suction port which is connected to the crank chamber, a scavenging flow passage which connects the scavenging port and the crank chamber, and a piston groove connecting between the leading air suction port and the scavenging port and for not connecting between the air-fuel mixture suction port and the scavenging port at a time of a suction stroke; and provided in an outer peripheral portion of the piston; and wherein the leading air suction port, the air-fuel mixture suction port, and the scavenging port are opened and closed due to a vertical motion of the piston, and wherein the leading air suction port and the air-fuel mixture suction port are positioned on opposite sides of an axis of the cylinder.

In accordance with the structure mentioned above, since the position of the leading air suction port is set to be opposite to that of the air-fuel mixture suction port, it is possible to sufficiently secure an opening area of the leading air suction port even when the length of the piston is short. Accordingly, it is possible to obtain the stratified scavenging two-stroke cycle engine which has an improved leading air suction efficiency, which is compact and light, which has a small placing space, and which has a low cost.

Further, the two-stroke cycle engine is structured such that the piston groove is not connected to the exhaust port at a top dead center, and an upper edge of the piston groove is positioned in a side of a cylinder head, in a direction of the cylinder axis, higher than a lower edge of the exhaust port and existent within a range not overlapping in the direction of the cylinder axis with a width portion, in a piston peripheral direction, of the exhaust port.

In accordance with the structure mentioned above, it is possible to increase the size of the piston groove in the cylinder axial direction. Accordingly, it is possible to increase a connecting time between the leading air suction port and the scavenging port at a time of the suction stroke so as to suck a lot of leading air. Therefore, since it is possible to increase a leading air suction efficiency even when reducing the length of the piston, it is possible to obtain the stratified scavenging two-stroke cycle engine which is compact and which has an improved performance.

Further, the structure may be made such that the twostroke cycle engine further comprises an air control valve arranged close to the leading air suction port for adjusting a suction air amount.

In accordance with the structure mentioned above, since the air control valve is provided close to the leading air suction port, the placing space is reduced, and a compact product structure can be obtained, so that a stratified scavenging two-stroke cycle engine excellent in a general purpose property can be obtained.

Further, the two-stroke cycle may be structured such that a valve body of the air control valve is integrally formed with the cylinder.

In accordance with the structure mentioned above, it is possible to reduce the number of parts, to make the structure simple, to make the structure light and compact, and to reduce a cost.

BEST MODE FOR CARRYING OUT THE INVENTION

A description of a preferred embodiment of a stratified scavenging two-stroke cycle engine in accordance with the present invention will be given below in detail with reference to FIGS. 1 to 11.

Figure 1:
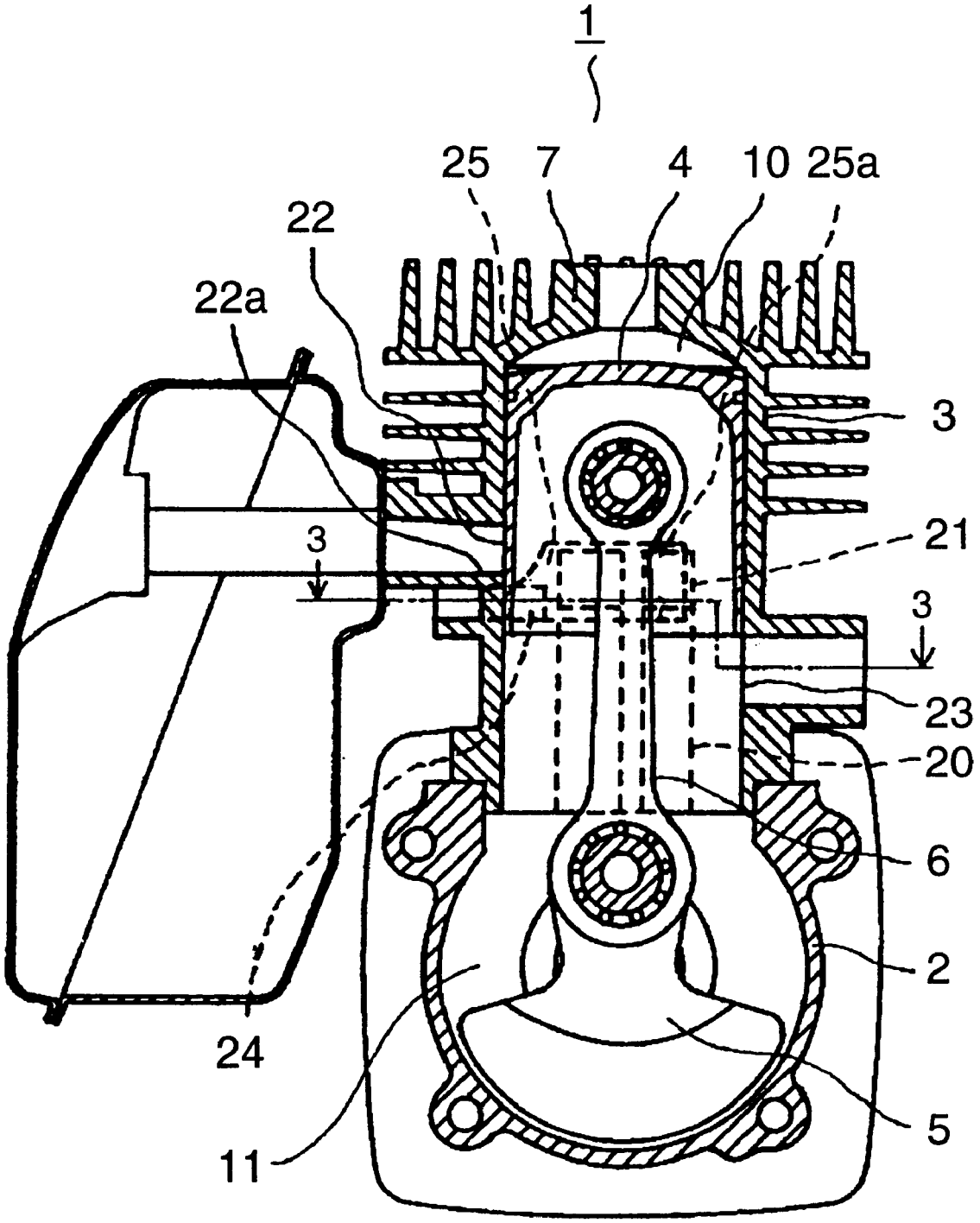
FIG. 1 is a front elevational cross sectional view of a stratified scavenging two-stroke cycle engine having a leading air introduction apparatus in accordance with a first embodiment of the present invention.
Figure 2:
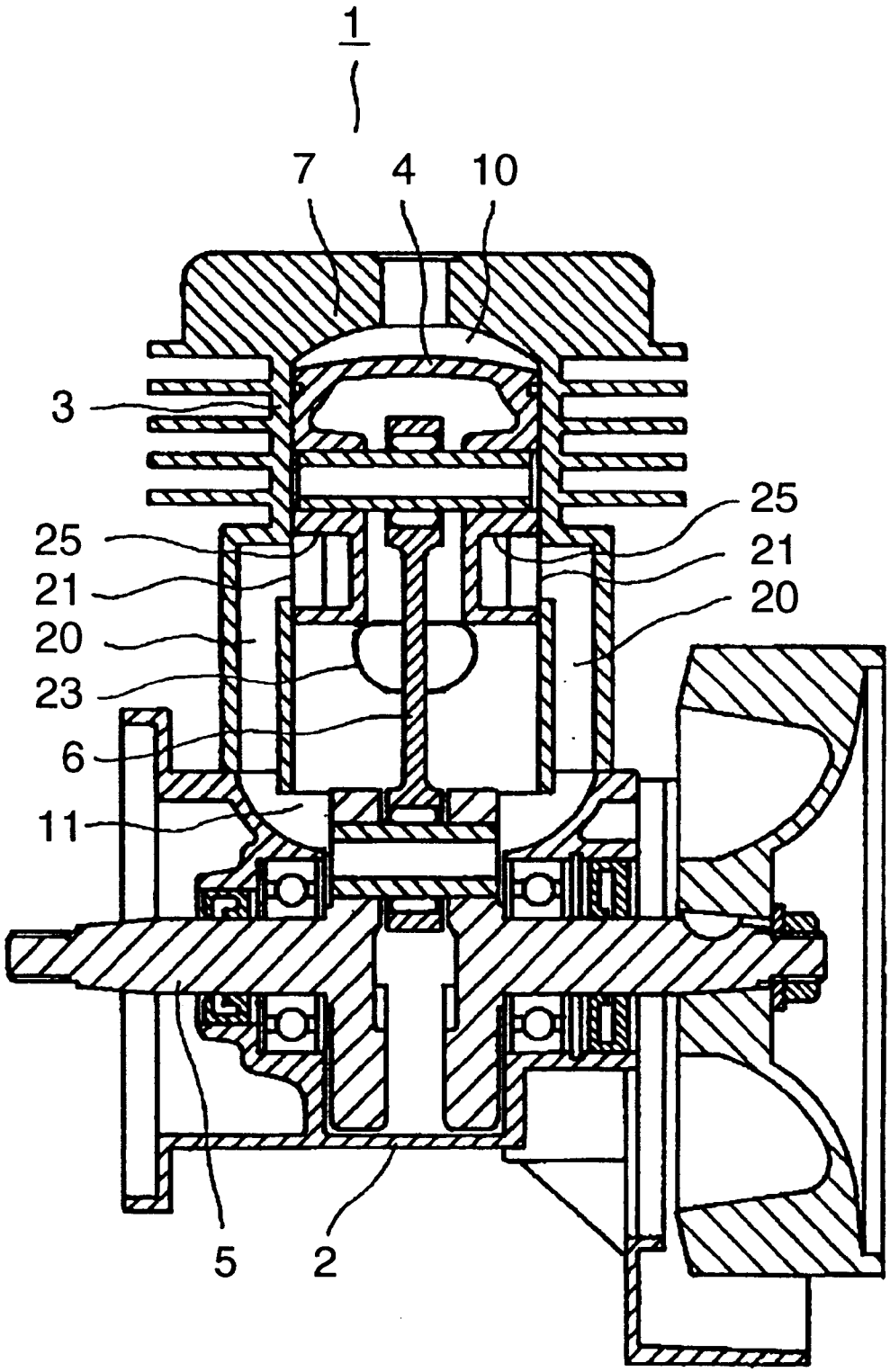
FIG. 2 is a side elevational cross sectional view of the stratified scavenging two-stroke cycle engine shown in FIG. 1.

FIG. 1 is a front elevational cross sectional view in a piston top dead center of a stratified scavenging two-stroke cycle engine 1 in accordance with a first embodiment, and FIG. 2 is a side elevational cross sectional view. In FIGS. 1 and 2, a piston 4 is closely and slidably inserted to a cylinder 3 attached to an upper side of a crank case 2. The piston 4 and a crank 5, which is rotatably attached to the crank case 2, are connected by a connecting rod 6. A space portion having a variable capacity, disposed above an upper side of the piston 4 within the cylinder 3, forms a cylinder chamber 10. Further, a space portion disposed in a lower side of the piston 4 and surrounded by the cylinder 3 and the crank case 2 forms a crank chamber 11. A cylinder head 7 is provided in an upper portion of the cylinder 3. An exhaust port 22 and a leading air suction port 24 are provided in one side of an inner peripheral surface of the cylinder 3, and an air-fuel mixture suction port 23 is provided in an opposite side of the inner peripheral surface. Further, pairs of scavenging flow passages 20 and 20, connecting the cylinder chamber 10 to the crank chamber 11, are respectively provided on opposite sides of the cylinder 3. The scavenging flow passages 20 and 20 are structured such that connection portions to the cylinder chamber 10 are open to the inner peripheral surface of the cylinder 3 so as to form scavenging ports 21 and 21. In this case, in FIG. 2, there is shown an embodiment in which two scavenging flow passages 20 and 20 and two scavenging ports 21 and 21 are respectively provided in opposite sides of the cylinder 3; however, the structure may be made such that one scavenging flow passage 20 and one scavenging port 21 are respectively provided in one side of the cylinder 3. Piston grooves 25 and 25, connecting the leading air suction port 24 to the scavenging port 21 at a time of the suction stroke, are respectively provided in outer peripheral surface portions of opposite sides of the piston 4.

Figure 3:
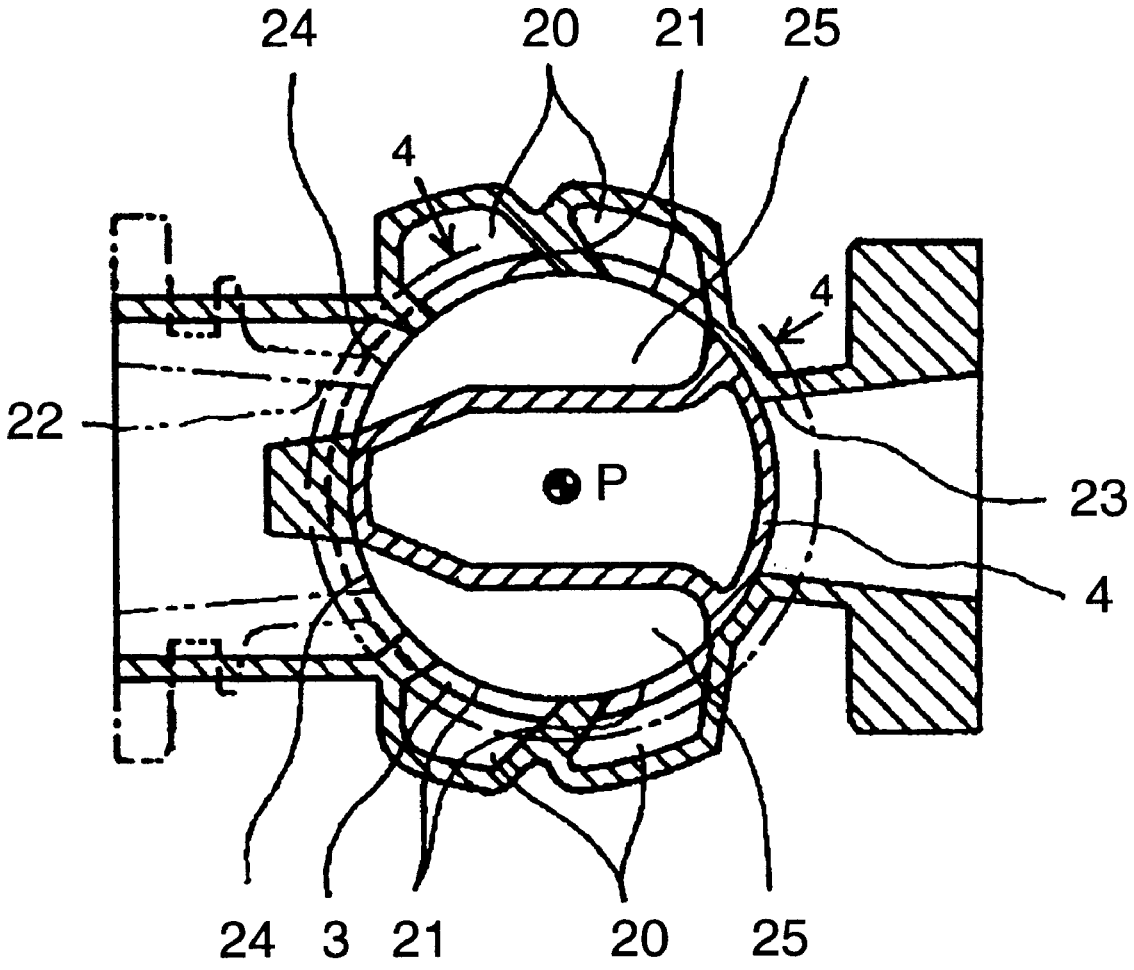
FIG. 3 is a cross sectional view along a line 3—3 in FIG. 1.

As shown in FIG. 3, the leading air suction ports 24 and the exhaust port 22 are provided in a side which is opposite to the side containing the air-fuel mixture suction port 23 with respect to a center axis (an axis) P of the cylinder 3. Two scavenging ports 21 and 21 in both sides are respectively provided at positions forming an angle of 90 degrees with respect to the air-fuel mixture suction port 23 and the leading air suction ports 24. Two piston grooves 25 and 25, provided in the outer peripheral surfaces on opposite sides of the piston 4, are provided at positions connecting the respective pair of scavenging ports 21 to the respective leading air suction port 24. In this case, the positions of the scavenging ports 21 are not always limited to the positions at 90 degrees, and can be suitably selected in correspondence to a positional relation between the leading air suction port 24 and the exhaust port 22, and may be asymmetrical. Further, the number of the scavenging ports 21 per side is not limited to two.

Figure 4:
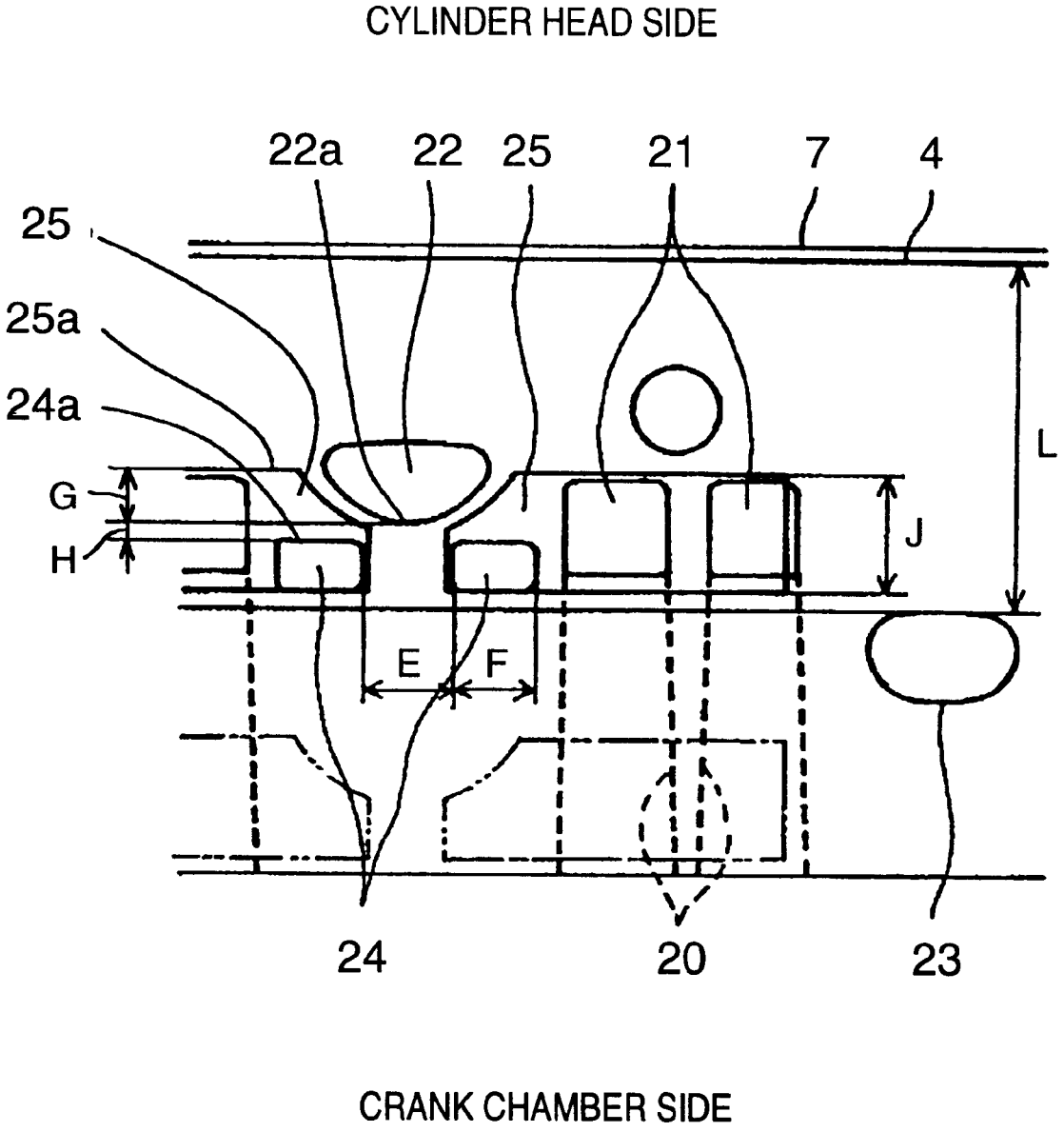
FIG. 4 is a schematic view of a cross section along line 4—4 in FIG. 3.

FIG. 4 corresponds to a development in a cross section along a line 4—4 in FIG. 3, and shows a mutual positional relation among the scavenging ports 21, the exhaust port 22, the air-fuel mixture suction port 23, the leading air suction ports 24 and the piston grooves 25 and 25 at the piston top dead center position. That is, the piston grooves 25 and 25 are not connected to the exhaust port 22 and the air-fuel mixture port 23 at the piston top dead center position, but connects the scavenging port 21 to the leading air suction port 24. Then, a piston groove upper edge 25*a* is positioned in a side of the cylinder head 7 at a distance G, in the axial direction of the piston 4, higher than an exhaust port lower edge 22*a*. Further, a leading air suction port upper edge 24*a* is positioned in a side of the crank chamber 11 at a distance H, in the axial direction of the piston 4, lower than the exhaust port lower edge 22*a*. Accordingly, it is possible to reduce an interval E between the two leading air suction ports 24 and 24 provided in right and left sides around the exhaust port 22, and it is possible to increase a width F of each leading air suction port 24 so as to increase a leading air suction area. Further, since the piston groove upper edge 25*a* is positioned in the side of the cylinder head 7 at the distance G higher than the exhaust port lower edge 22*a,* it is possible to increase a size J in the cylinder axial direction of the piston groove 25 even when reducing an axial length L of the cylinder 3. In this case, each piston groove 25 is provided at a position in which it is not connected to the air-fuel mixture suction port 23 between the piston top dead center position and the piston bottom dead center position, shown by a two-dot chain line.

Figure 5:
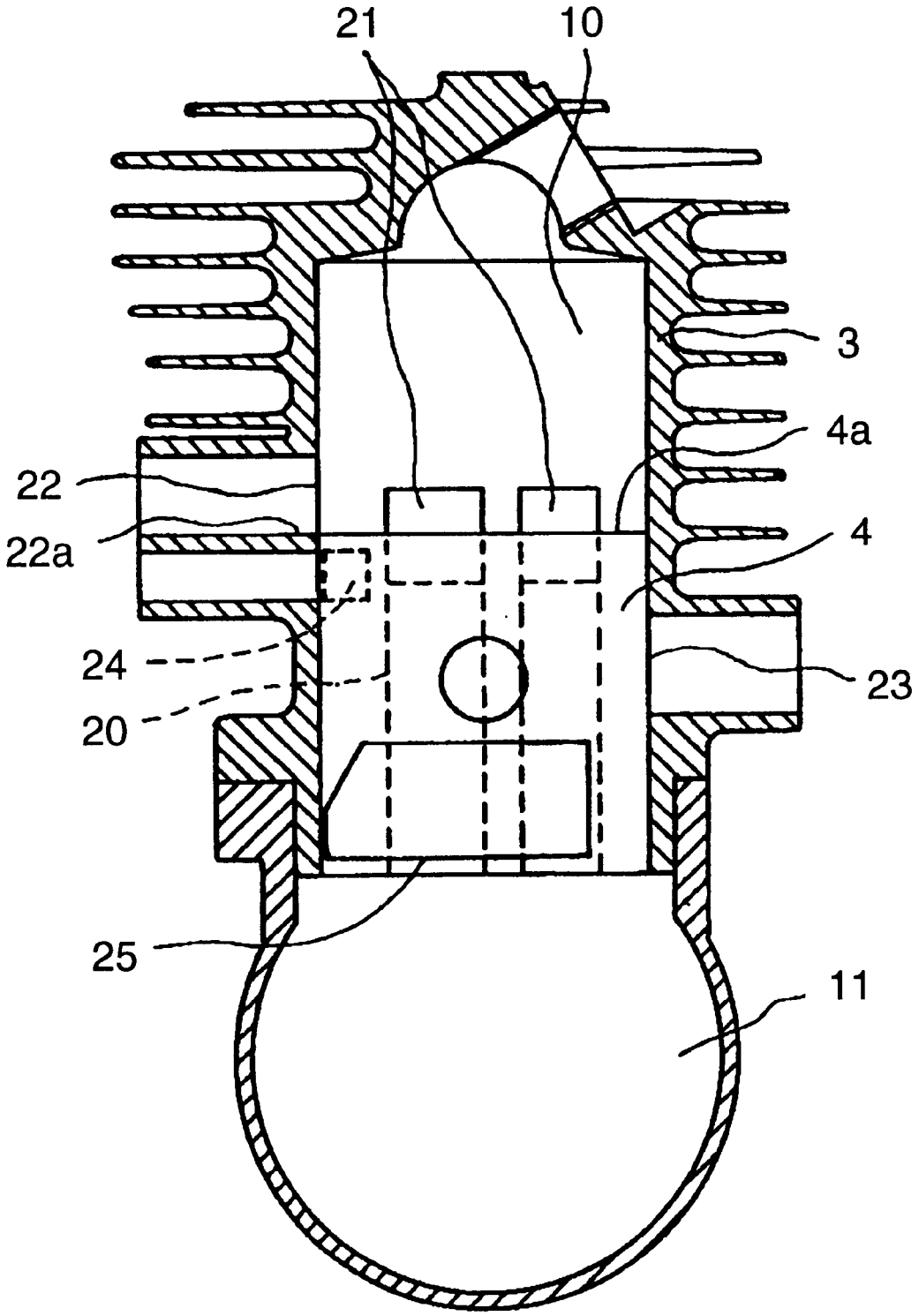
FIG. 5 is a schematic view showing an operation at a time of a piston bottom dead center in accordance with the first embodiment of the present invention.

Next, a description will be given of an operation of the structure mentioned above. FIG. 5 is a schematic view showing a positional relation of the respective ports at the piston bottom dead center position corresponding to a final stroke of an explosion and an exhaust at which the piston 4 moves downwardly. The scavenging ports 21 and the exhaust port 22 are connected to the cylinder chamber 10. The piston upper edge 4*a* is positioned close to the exhaust port lower edge 22*a*. The leading air suction ports 24 are closed by the piston 4, and the leading air suction ports 24 and the scavenging ports 21 are not connected. Each scavenging port 21 is connected to the crank chamber 11 via a scavenging flow passage 20, and the air-fuel mixture suction port 23 is closed by the piston 4. That is, the exhaust gas is discharged from the exhaust port 22 due to the leading air pressed out from the scavenging ports 21. The air-fuel mixture in the crank chamber 11 is supplied to the cylinder chamber 10 via the scavenging ports 21 and the scavenging flow passages 20.

Figure 6:
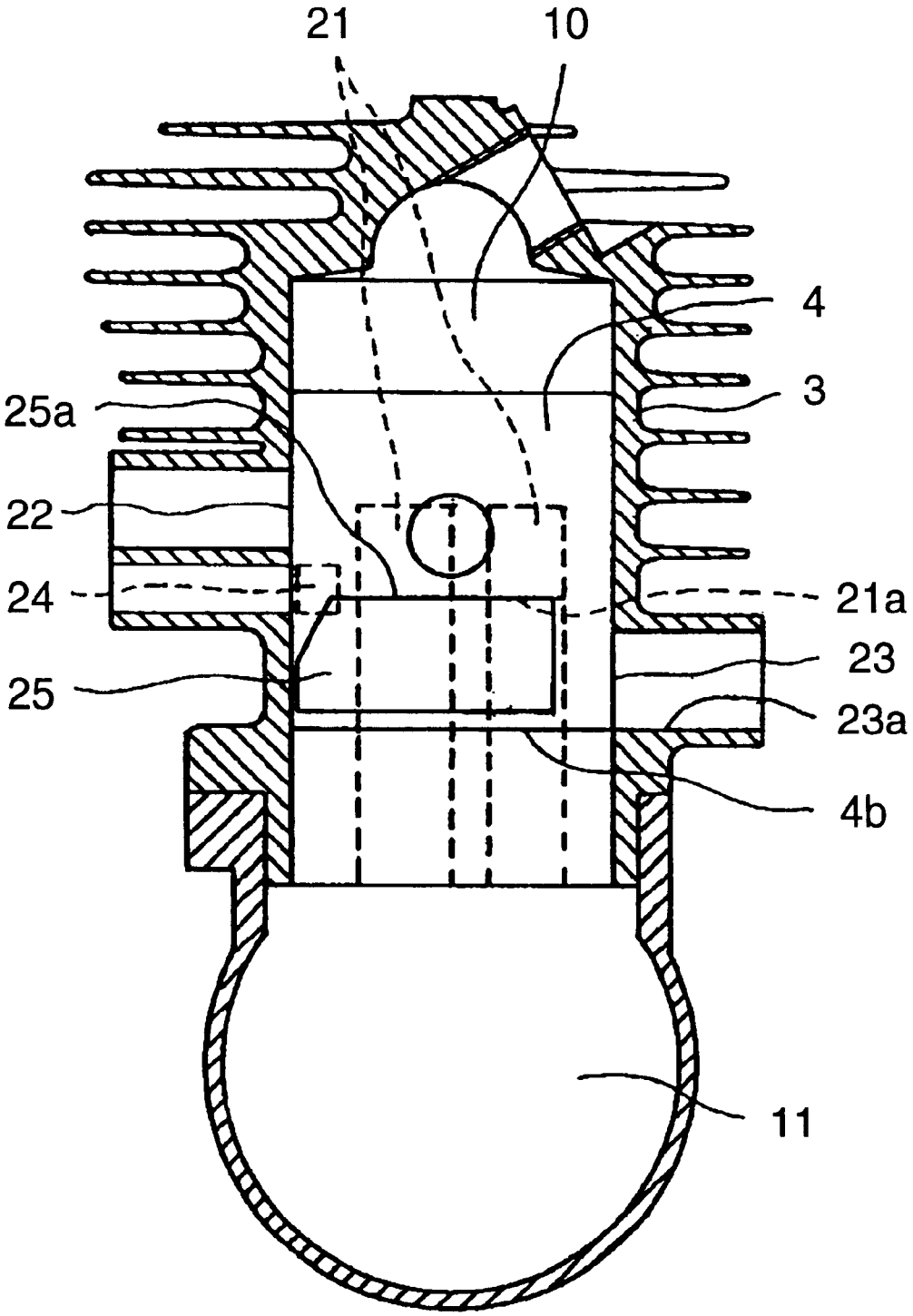
FIG. 6 is a schematic view showing an operation at a time of a piston middle point in accordance with the first embodiment of the present invention.

FIG. 6 shows a positional relation of the respective ports at the middle stroke of the compression and the suction at which the piston 4 moves upwardly, and shows a state in which the piston 25 starts connecting to the leading air suction ports 24. That is, the exhaust port 22 and the scavenging ports 21 are closed by the piston 4. The piston groove upper edges 25*a* are at the position of the scavenging port lower edges 21*a,* and the leading air suction ports 24 and the scavenging ports 21 are in a state of starting to connect via the piston grooves 25. Further, the piston lower edge 4*b* is at the position of the air-fuel mixture suction port lower edge 23*a,* and in a state of starting the sucking of the air-fuel mixture. In this state, the air-fuel mixture in the cylinder chamber 10 above the piston 4 is compressed, and the internal pressure of the crank chamber 11 is reduced. In this case, with respect to the timings of opening and closing the leading air suction ports 24 and the air-fuel mixture suction port 23, the timings are set to be simultaneous, however, it is not necessary to always be set to be simultaneous.

When the piston 4 moves upwardly from the state shown in FIG. 6, each leading air suction port 24 is connected to the respective scavenging ports 21 via the respective piston groove 25, and the leading air flows into the respective scavenging flow passages 20. At the same time, the air-fuel mixture suction port 23 is opened so as to be connected to the crank chamber 11, and the air-fuel mixture is sucked into the crank chamber 11.

Figure 7:
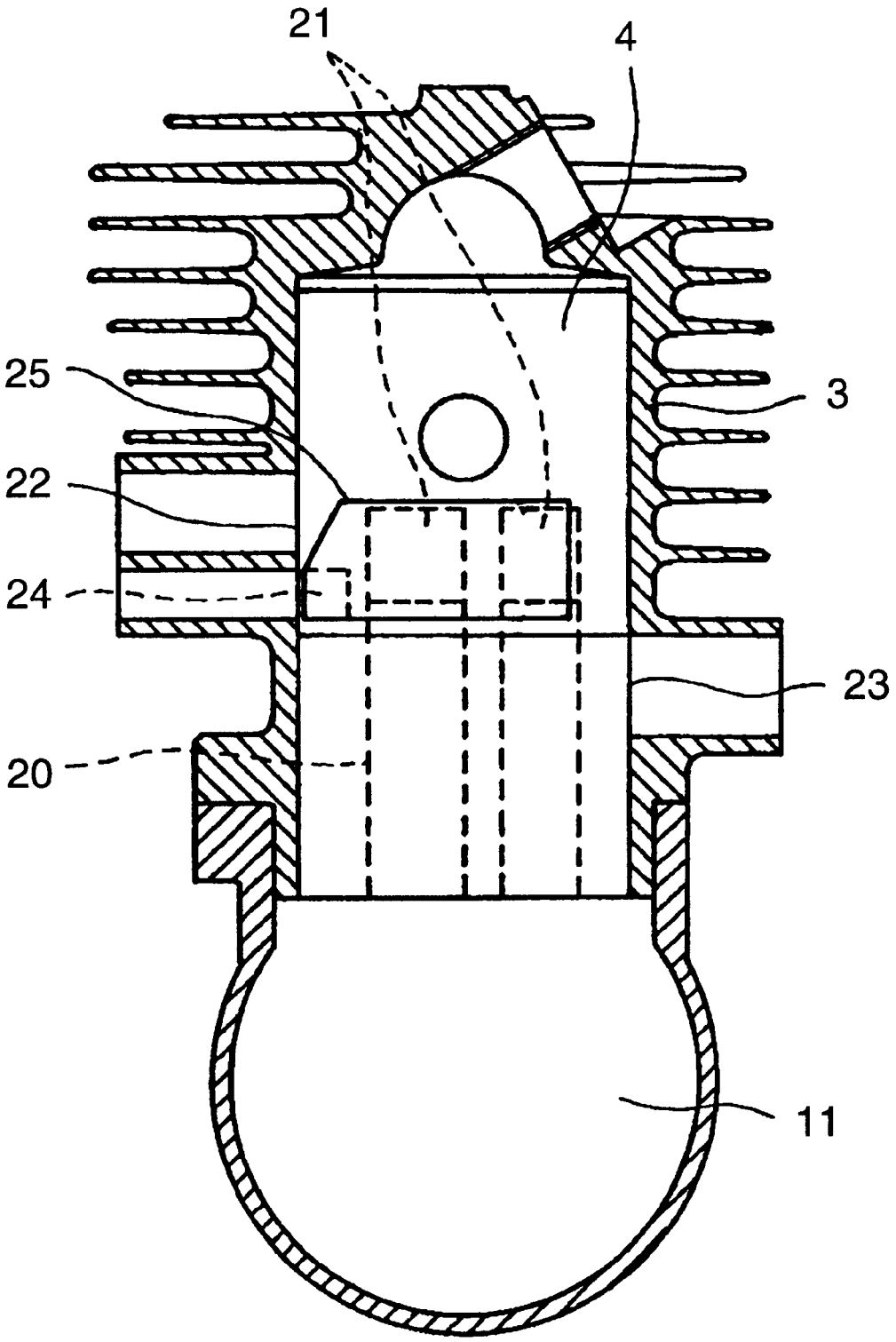
FIG. 7 is a schematic view showing an operation at a time of a piston top dead center in accordance with the first embodiment of the present invention.

Next, when the piston 4 reaches the top dead center position as shown in FIG. 7, the exhaust port 22 is closed by the piston 4, the leading air suction ports 24 and the scavenging ports 21 are connected in a full open state via the piston grooves 25, and the air-fuel mixture suction port 23 is connected in a full open state to the crank chamber 11.

As mentioned above, in the stratified scavenging two-stroke cycle engine 1 in accordance with the first embodiment, since the positions of the leading air suction ports 24 and 24 are set to be in a side opposite to the air-fuel mixture suction port 23, it is possible to increase the opening area of the leading air suction ports 24 and 24 even though the length of the piston 4 is short. Further, the piston groove upper edges 25*a,* existent within the range not overlapping in the cylinder axial direction with the width portion, in the piston peripheral direction, of the exhaust port 22, are positioned in the side of the cylinder head 7 in the cylinder axial direction higher than the exhaust port lower edge 22*a*. Accordingly, it is possible to increase the size J in the cylinder axial direction of the piston grooves 25. Therefore, it is possible to increase the cross sectional area of each piston groove 25, that is, the leading air passing area, and it is possible to increase the connection time between the leading air suction port 24 and the associated scavenging ports 21 at a time when the piston 4 vertically moves so as to suck a lot of leading air, so that it is possible to improve a suction efficiency of the leading air. Further, since the length of the piston 4 can be made the same as the conventional one even when increasing the area of the leading air suction ports 24, it is possible to make the structure compact and light, and it is possible to obtain a stratified scavenging two-stroke cycle engine 1 having a reduced cost.

Figure 8:
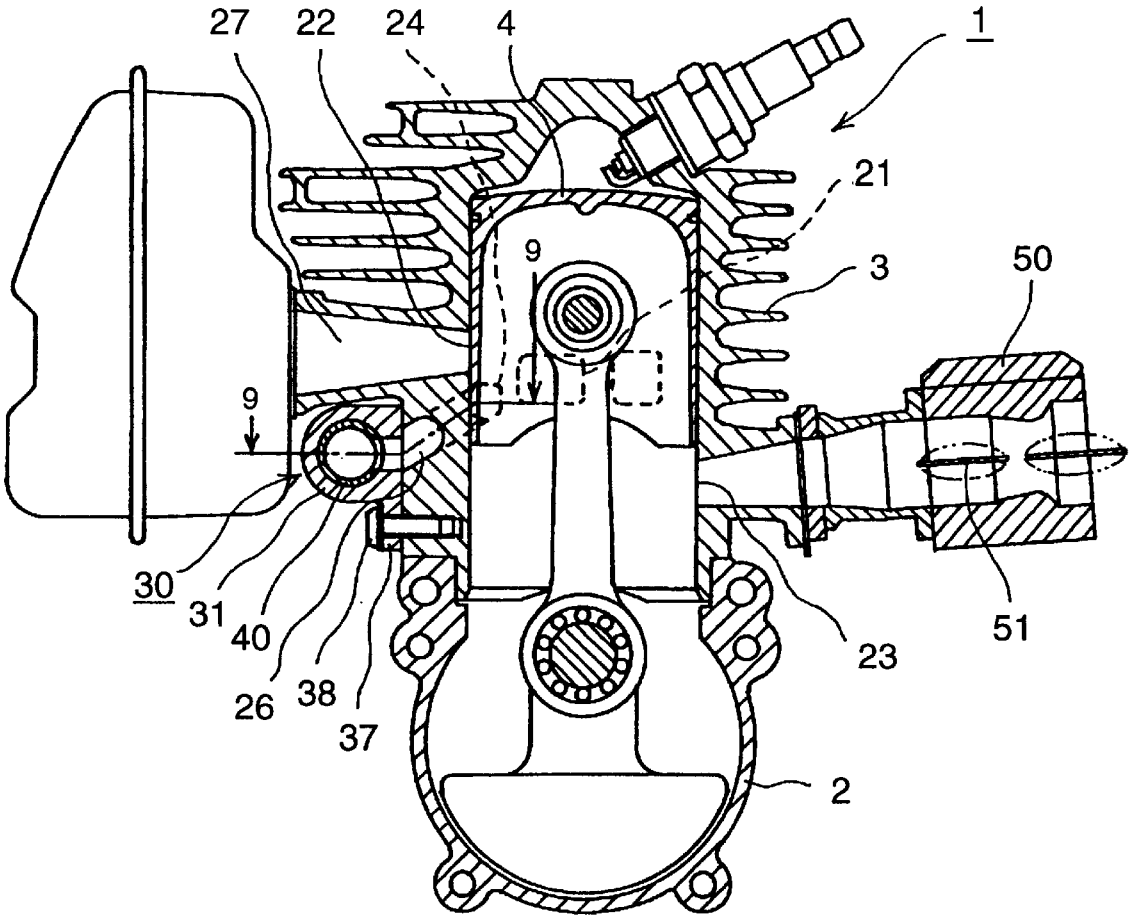
FIG. 8 is a front elevational cross sectional view of a stratified scavenging two-stroke cycle engine having an air control valve in accordance with a second embodiment of the present invention.
Figure 9:
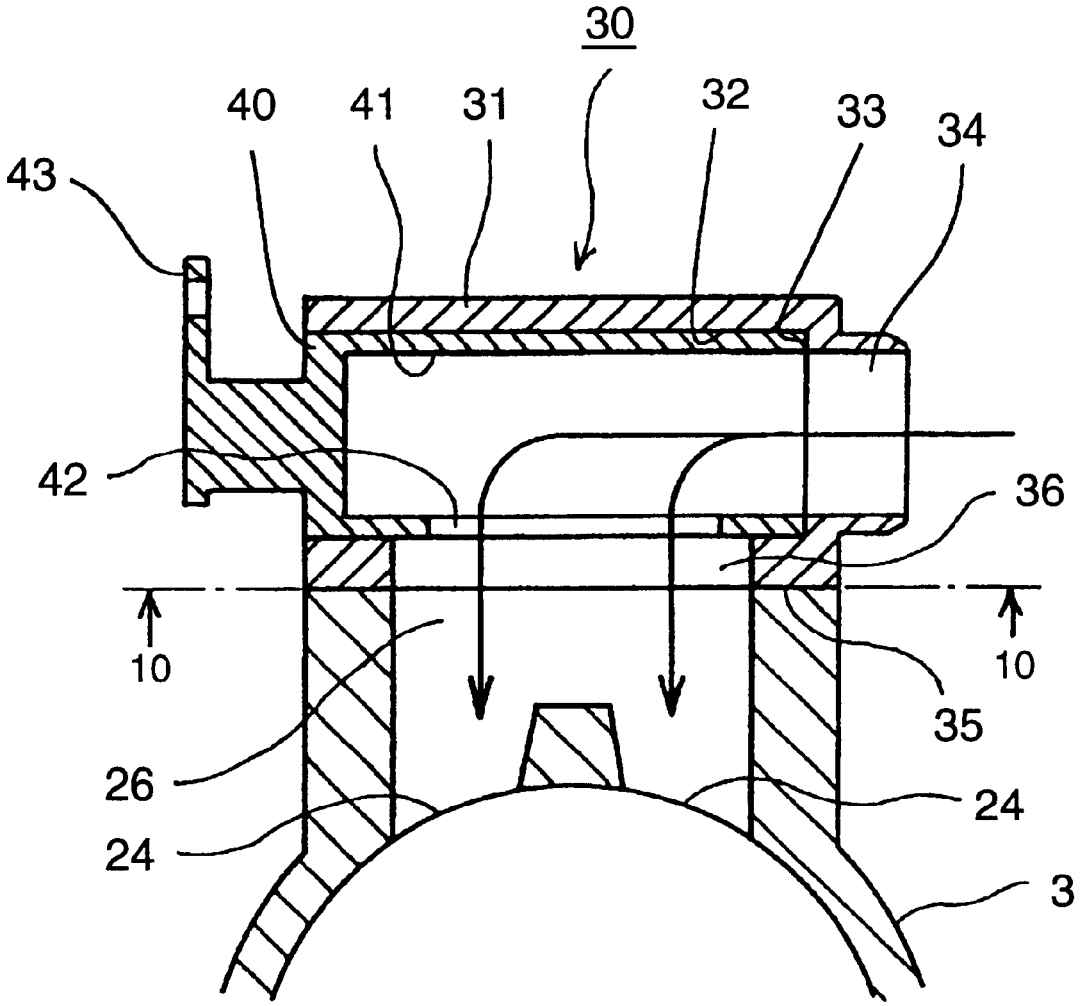
FIG. 9 is a cross sectional view along a line 9—9 in FIG. 8.

FIG. 8 is a front elevational cross sectional view of a stratified scavenging two-stroke cycle engine 1 provided with an air control valve in accordance with a second embodiment, and FIG. 9 is a cross sectional view along a line 9—9 in FIG. 8. The same reference numerals are attached to the same elements as those shown in FIG. 1, a description thereof will be omitted and a description will be given of only different parts. In FIGS. 8 and 9, a carburetor 50 having an air throttle valve 51 is arranged in an upstream side of an air-fuel mixture suction port 23. A rotary valve type air control valve 30 is attached to a portion in an inlet port of a leading air suction passage 26 communicating with a leading air suction port 24 of a cylinder 3 and below an exhaust pipe 27 connecting to an exhaust port 22. A stepped cylindrical hole 32 is provided in a valve body 31 of the air control valve 30, and a rotary valve 40 is rotatably inserted into the stepped cylindrical hole 32. An air intake port 34 communicating with the stepped cylindrical hole 32 is provided at an end portion in a side of a stepped portion 33 of the stepped cylindrical hole 32, and is connected to an air cleaner (not shown) via a suction pipe (not shown). An air discharge port 36 connecting the stepped cylinder hole 32 to the leading air suction passage 26 is provided in a mounting surface 35 of the valve body 31 to the cylinder 3. A flange 37 is provided in the valve body 31, and is fastened to the cylinder 3 by a bolt 38. An air communication hole 41, communicating with the air intake port 34, is provided in the rotary valve 40. Further, a communication hole 42, rotating so as to open and close the communication passage between the air communication hole 41 and the leading air suction passage 26, is provided in a wall surface of the rotary valve 40.

Figure 10:
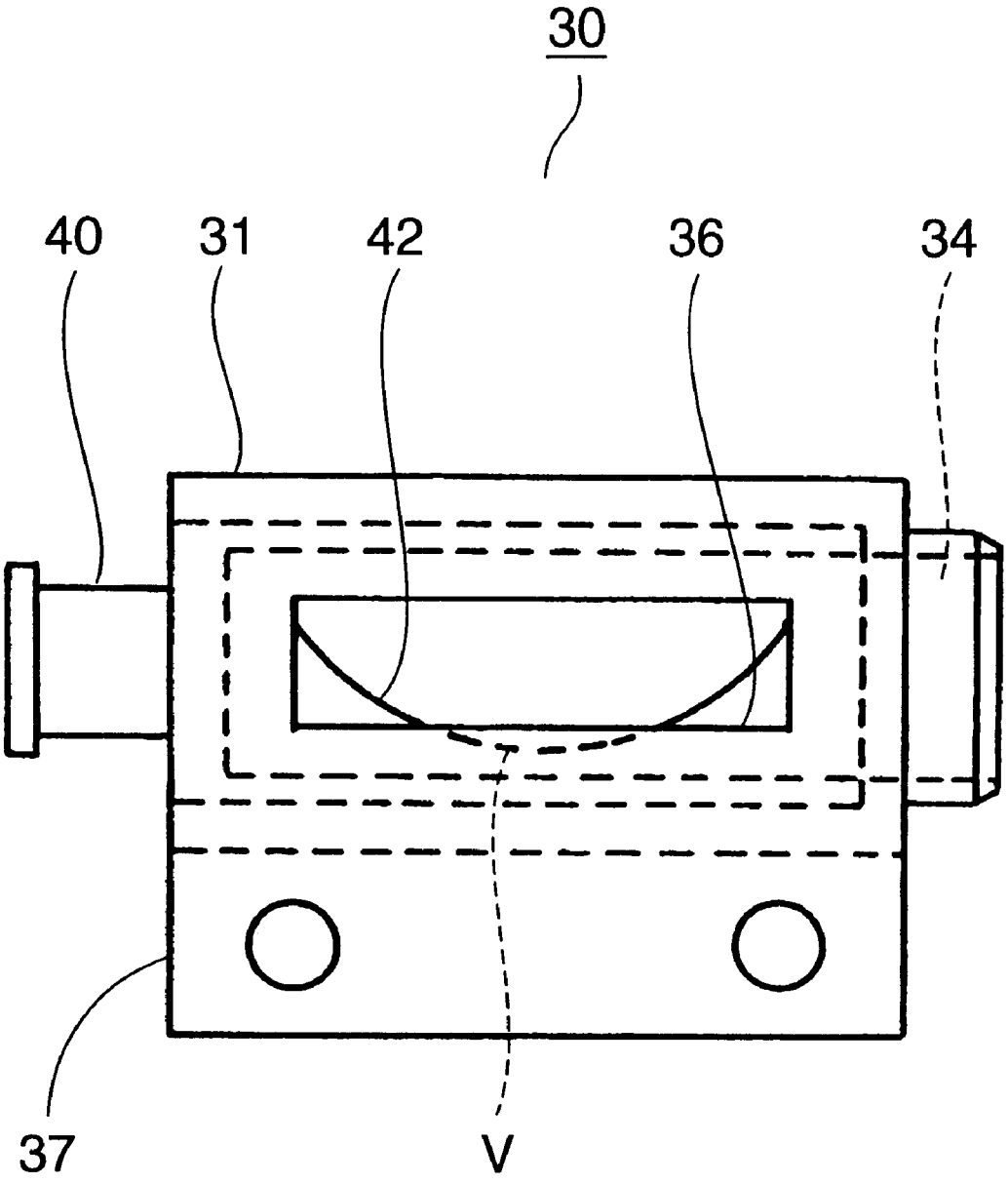
FIG. 10 is a cross sectional view along a line 10—10 in FIG. 9.

FIG. 10, corresponding to a cross sectional view along a line 10—10 in FIG. 9, shows a state that the valve is opened. The air discharge port 36, provided in the valve body 31, is formed in a rectangular shape; on the contrary, the communication hole 42 provided in the rotary valve 40 is formed in a meniscus shape. Accordingly, in the case of rotating the rotary valve 40 from a closed position to an open position, the passage gradually starts opening from a top portion V of a circular arc, and can gradually increase the passage area. A lever 43 (refer to FIG. 9), provided in one end portion of the rotary valve 40, is connected to the air throttle valve 51 (refer to FIG. 8) of the carburetor 50 by a link apparatus (not shown) so as to interlock therewith. It is executed by the lever 43 to make the opening area zero or small at a time when the engine is under an idling or under a low load operation, or it is executed to increase the opening area in correspondence to the load at a time when the engine is under a high load, whereby necessary air can be sucked.

As shown in FIG. 9, when the rotary valve 40 is rotated, and the communication hole 42 and the air discharge port 36 are communicated, the air passes through the air communication hole 41 from the air intake port 34, as shown by an arrow, and is supplied to the leading air suction port 24 via the leading air suction passage 26.

As described above, in accordance with the second embodiment, the rotary valve type air control valve 30 is arranged close to the leading air suction port 24. Accordingly, it is possible to supply a predetermined amount of leading air in correspondence to the engine load, the structure can be made compact, simple and light, the structure can be made compact in the case of constituting the product, and it is possible to obtain a low cost stratified scavenging two-stroke cycle engine 1.

Figure 11:
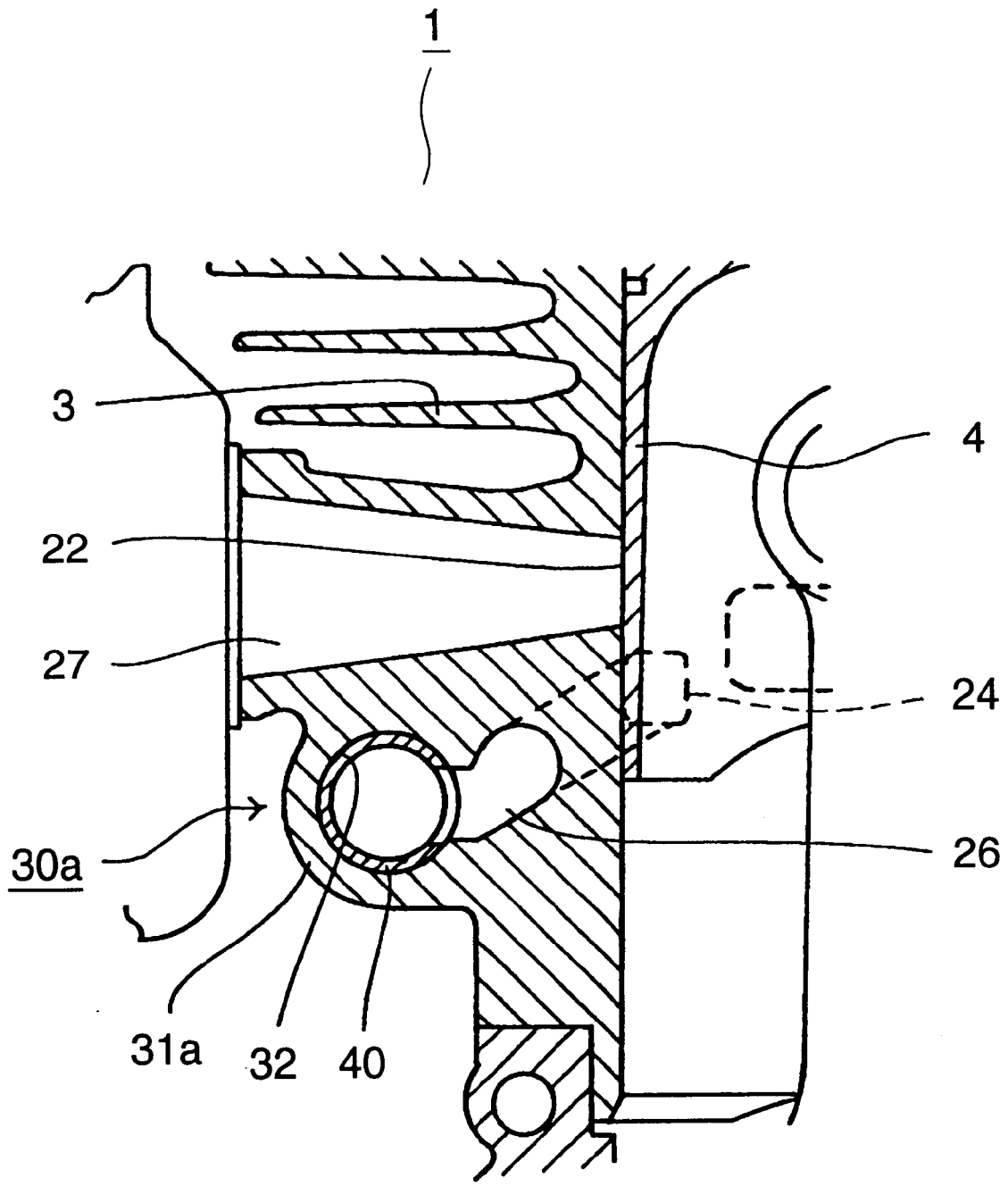
FIG. 11 is a cross sectional view of a main portion of a stratified scavenging two-stroke cycle engine having an air control valve in accordance with a third embodiment of the present invention.
Figure 12:
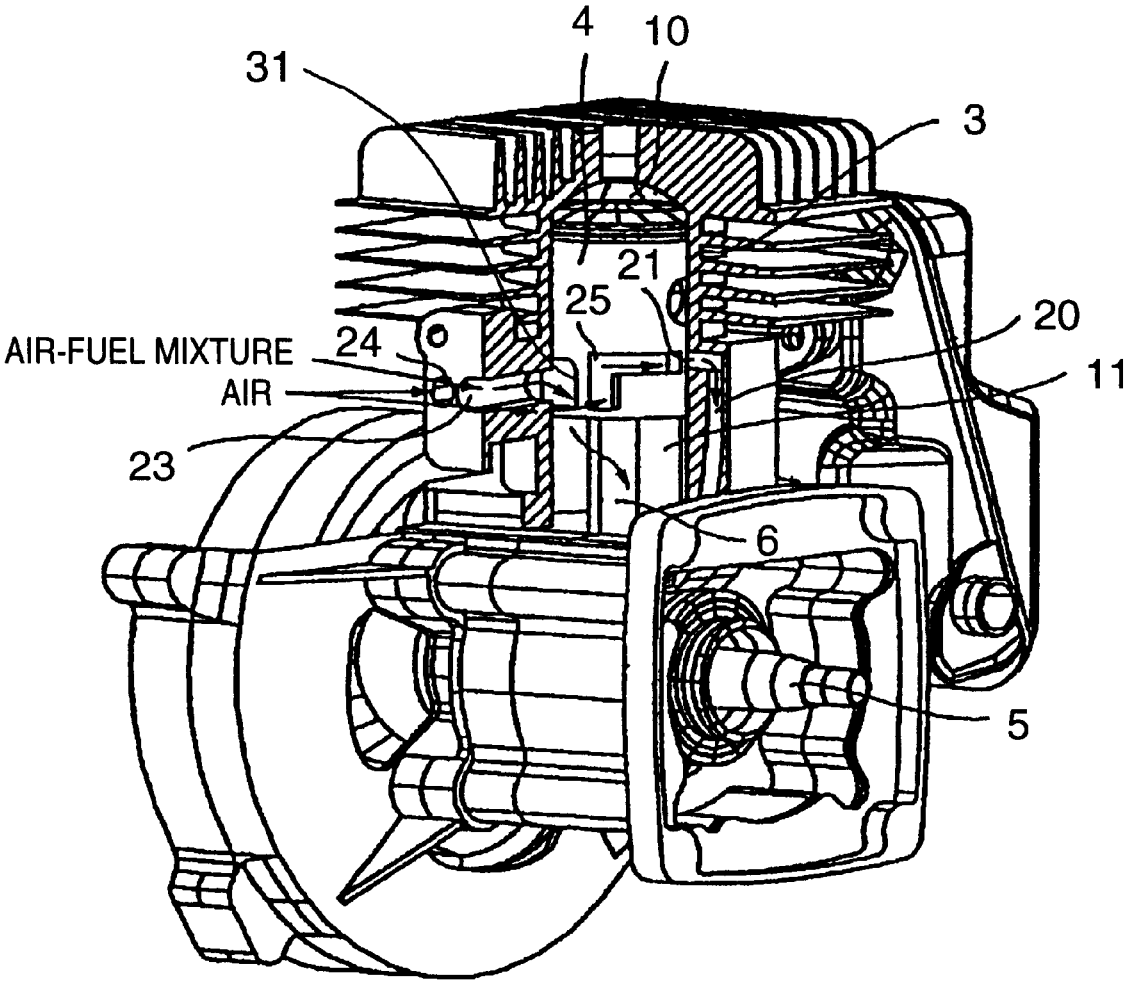
FIG. 12 PRIOR ART
FIG. 12 is a broken perspective view of a main portion of a stratified scavenging two-stroke cycle engine in accordance with a conventional art.
Figure 13:
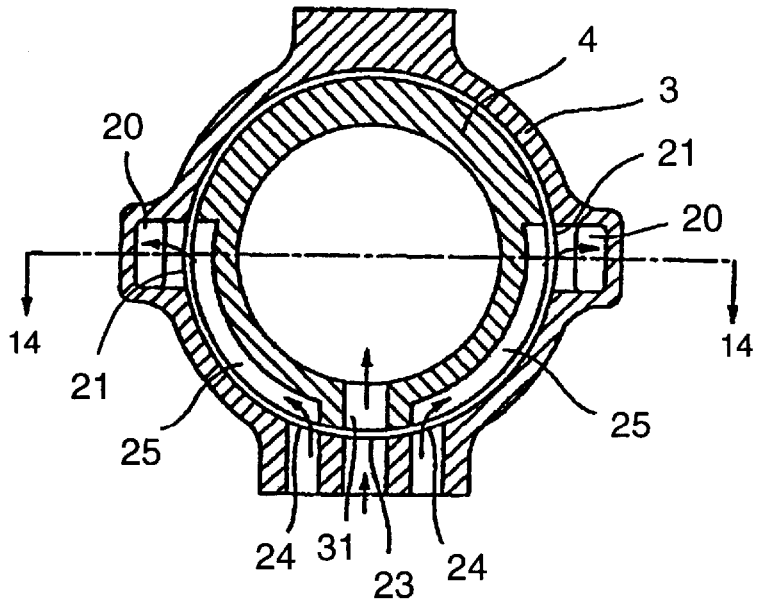
FIG. 13 PRIOR ART
FIG. 13 is a plan cross sectional view of the stratified scavenging two-stroke cycle engine shown in FIG. 12, and corresponds to a cross sectional view along a line 13—13 in FIG. 14.
Figure 14:
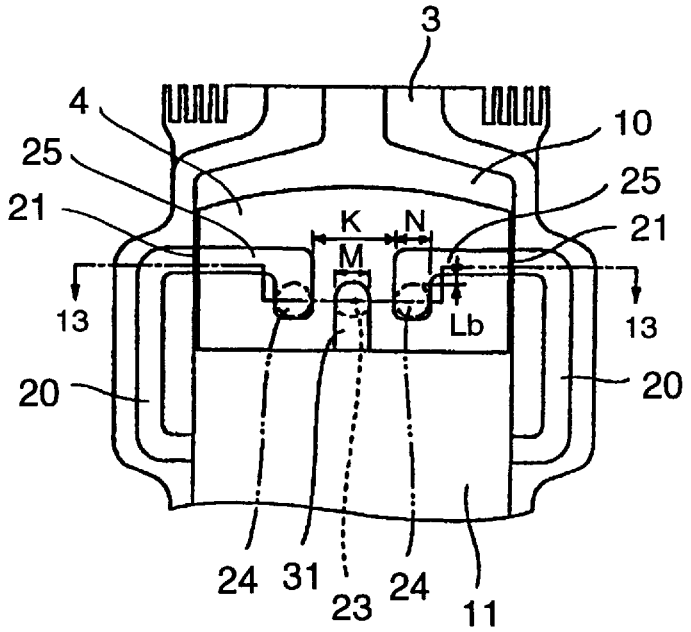
FIG. 14 PRIOR ART
FIG. 14 is a side elevational cross sectional view of a portion near a piston top dead center of the stratified scavenging two-stroke cycle engine shown in FIG. 12, and corresponds to a cross sectional view along a line 14—14 in FIG. 13.
Figure 15:
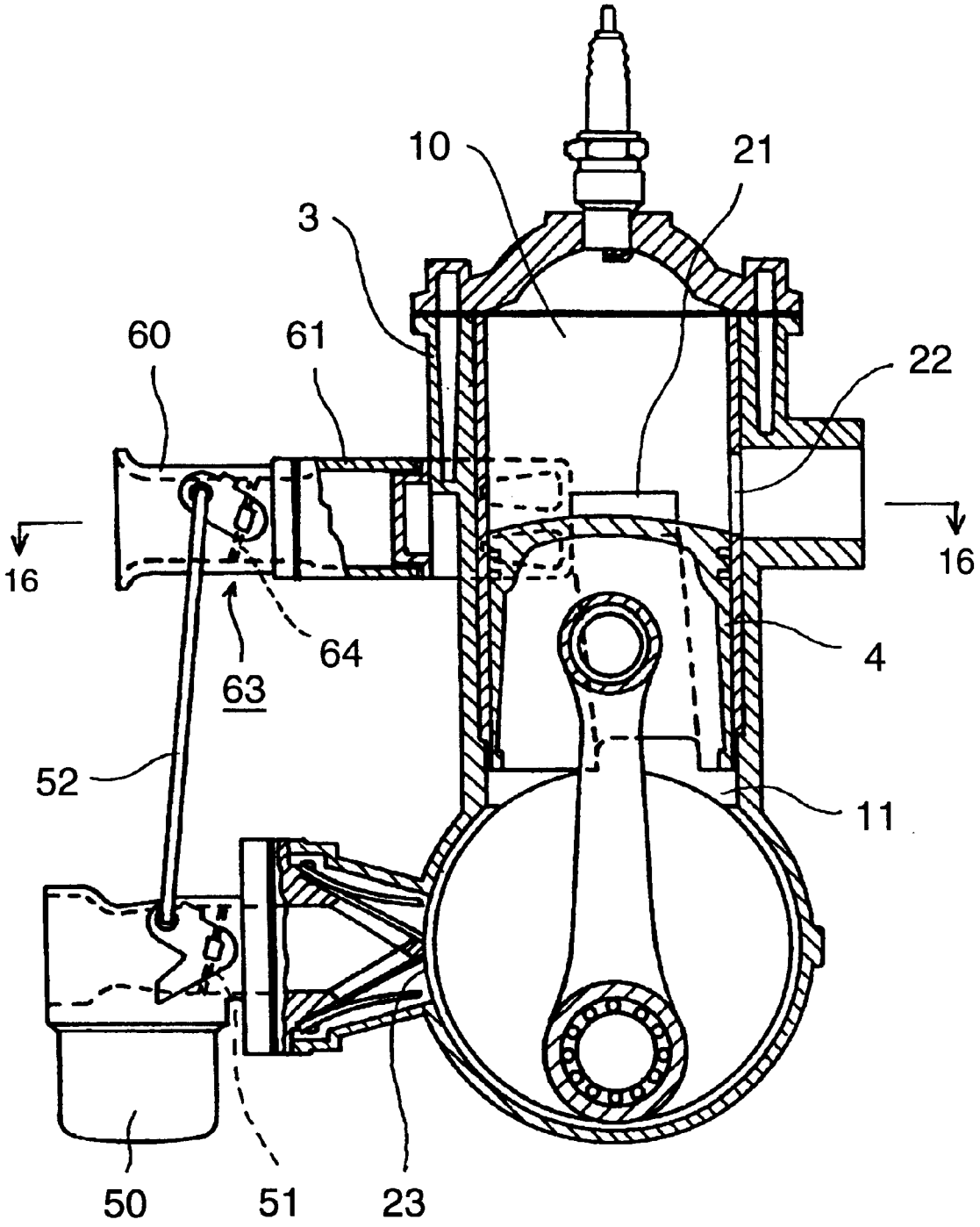
FIG. 15 PRIOR ART
FIG. 15 is a front elevational cross sectional view of a stratified scavenging two-stroke cycle engine provided with an air control valve in accordance with the conventional art.
Figure 16:
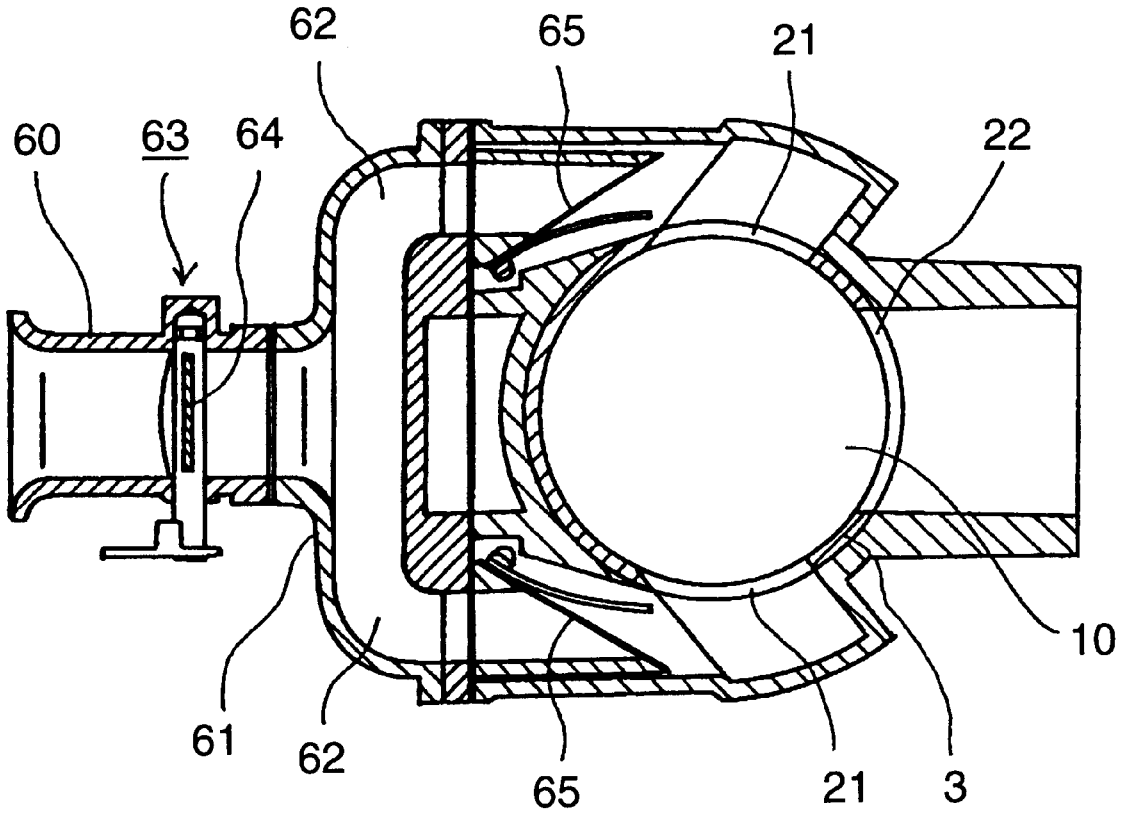
FIG. 16 PRIOR ART
FIG. 16 is a cross sectional view along a line 16—16 in FIG. 15.
Figure 17:
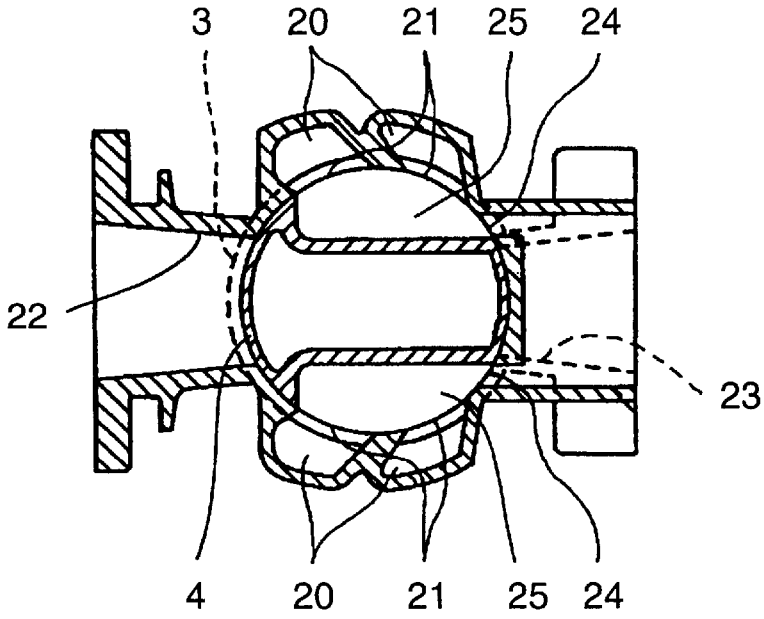
FIG. 17 PRIOR ART
FIG. 17 is a plan cross sectional view of a cylinder portion at a time of a piston top dead center of the stratified scavenging two-stroke cycle engine shown in FIG. 12.
Figure 18:
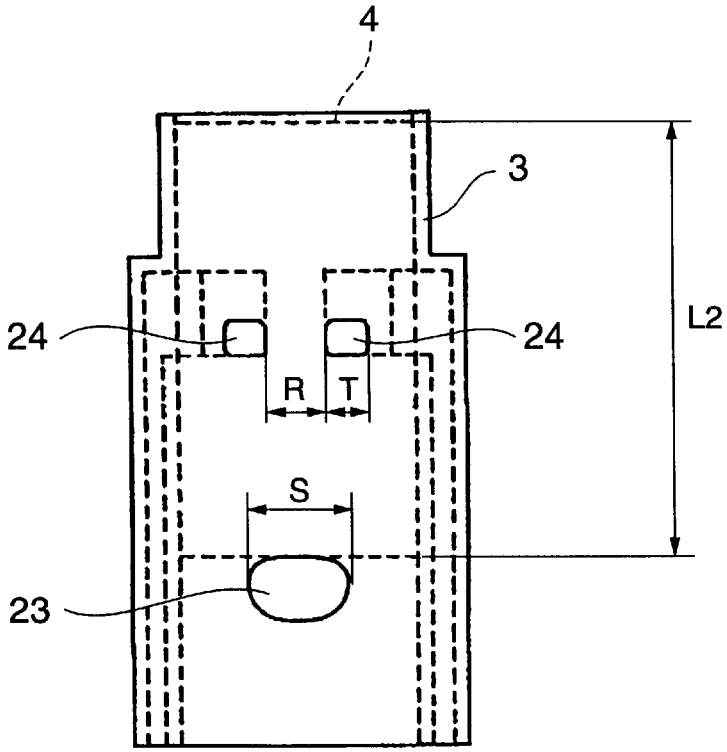
FIG. 18 is a side elevational schematic view of a cylinder describing a structural embodiment in which an air-fuel mixture suction port and two leading air suction ports are provided so as to be shifted a predetermined distance with respect to each other in a direction of a cylinder axis.

FIG. 11 is a cross sectional view of a main portion of a stratified scavenging two-stroke cycle engine 1 provided with an air control valve 30*a* in accordance with a third embodiment. A valve body 31*a,* integrally formed with a cylinder 3, is provided in a terminal portion of a leading air suction passage 26 in the cylinder 3. A rotary valve 40 is rotatably inserted into a stepped cylindrical hole 32 pierced in the valve body 31*a*. Since structures and operations of the other members are the same as that of the air control valve 30 in accordance with the second embodiment, a description thereof will be omitted.

In the third embodiment, since the valve body 31*a* is integrally structured with the cylinder 3, the number of the parts is reduced and a simple structure can be obtained, so that the structure can be made more compact and the cost can be reduced.

INDUSTRIAL APPLICABILITY

The present invention is:useful for the stratified scavenging two-stroke cycle engine which can improve a suction efficiency of the leading air, make the piston compact, and has a simple structure and a low cost.

What is claimed is:

1. A stratified scavenging two-stroke cycle engine comprising:

an exhaust port (22) and a scavenging port (21) which are connected to a cylinder chamber (10) of the engine;

a leading air suction port (24) not connected to said cylinder chamber and a crank chamber (11) during all of strokes of a piston (4);

an air-fuel mixture suction port (23) connected to said crank chamber;

a scavenging flow passage (20) connecting between said scavenging port and said crank chamber;

a piston groove (25) connecting between said leading air suction port and said scavenging port and not connecting between said air-fuel mixture suction port and said scavenging port at a time of a suction stroke, and provided in an outer peripheral portion of said piston; and said leading air suction port, said air-fuel mixture suction port, and said scavenging port are opened and closed due to a vertical motion of said piston;

wherein said leading air suction port (24) is positioned in a same side as said exhaust port (22).

2. A stratified scavenging two-stroke cycle engine as claimed in claim 1, wherein said piston groove (25) is not connected to said exhaust port (22) at a top dead center, and an upper edge (25*a*) of the piston groove is positioned at a side of a cylinder head (7) in a direction of the cylinder (3) axis higher than a lower edge (22*a*) of the exhaust port existent within a range not overlapping in the direction of the cylinder axis with a width portion, in a piston peripheral direction, of said exhaust port.

3. A stratified scavenging two-stroke cycle engine as claimed in claim 1 or 2, wherein a leading air suction port upper edge (24*a*) of said leading air suction port (24) is positioned in a side of the crank chamber (11) in the axial direction of the cylinder lower than an exhaust port lower edge (22*a*) of said exhaust port (22).

* * * * *